United States Patent [19]

Davis

[11] Patent Number: 4,503,633

[45] Date of Patent: Mar. 12, 1985

[54] MUZZLE LOADING FIREARM

[75] Inventor: Clifford Davis, Sherman Township, St. Joseph County, Mich.

[73] Assignees: Edward D. Jasper, Shipshewana, Ind.; Rolland Bohm, Centreville, Mich.

[21] Appl. No.: 465,698

[22] Filed: Feb. 10, 1983

[51] Int. Cl.[3] ..... F41C 7/00; F41C 19/00

[52] U.S. Cl. ..... 42/51; 42/69 R; 42/71 R

[58] Field of Search ..... 42/51, 69 R, 71 R

[56] References Cited

U.S. PATENT DOCUMENTS

| | | | |
|---|---|---|---|
| 43,881 | 8/1864 | Graham | 42/69 |
| 44,784 | 10/1864 | Colvin | 42/51 |
| 237,357 | 2/1881 | Zundorff | 42/51 |
| 269,152 | 12/1882 | Zundorff | 42/51 |
| 2,337,145 | 12/1943 | Albree | 42/69 |
| 2,451,527 | 10/1948 | Albree | 42/69 |
| 2,990,471 | 6/1961 | Tiffany | 42/1 R |
| 3,011,283 | 12/1961 | Lunn | 42/71 R |
| 3,020,662 | 2/1962 | Merkel | 42/11 |
| 3,023,527 | 3/1962 | Leek | 42/71 R |
| 3,757,447 | 9/1973 | Rowe | 42/51 |
| 3,849,924 | 11/1974 | Whitlinger | 42/51 |
| 4,020,740 | 5/1977 | Schirneker | 42/71 R |
| 4,065,866 | 1/1978 | Eguizabal | 42/51 |
| 4,114,303 | 9/1978 | Vaughn | 42/51 |
| 4,215,502 | 8/1980 | Loven | 42/51 |
| 4,283,874 | 8/1981 | Vaughn | 42/51 |

*Primary Examiner*—Charles T. Jordan

*Attorney, Agent, or Firm*—Price, Heneveld, Huizenga & Cooper

[57] ABSTRACT

A muzzle loading firearm, such as a rifle, having a firing nipple which communicates with the rear of the barrel bore and mounts thereon a firing cap. The nipple is positioned within a chamber formed in the interior of the stock directly adjacent the rear end of the barrel. The chamber opens outwardly through one side surface of the stock. An openable and closable cover is mounted on the stock adjacent the side surface thereof for permitting closing of the chamber. The trigger mechanism is mounted on the stock substantially forwardly from the firing nipple. An elongated firing rod is slidably mounted internally of the stock and projects forwardly from the chamber to the trigger mechanism. A latching structure coacts between the trigger member and the firing rod to hold same in a forward position such that, when the trigger is activated, the firing rod is released and spring urged rearwardly to impact against and detonate the firing cap.

12 Claims, 5 Drawing Figures

MUZZLE LOADING FIREARM

FIELD OF THE INVENTION

This invention relates to a muzzle-loading firearm and, in particular, to an improved firing mechanism for such firearm.

BACKGROUND OF THE INVENTION

Most muzzle-loading rifles have the firing mechanism for the detonator cap mounted externally of the stock on the side thereof in the vicinity of the rear end of the rifle barrel. The firing mechanism for the cap is normally a long pivoted lever coupled to the trigger such that, upon squeezing the trigger, the lever is released and spring-urged so as to impact against the cap to effect detonation thereof. However, since the cap is positioned externally of the stock, the cap is subject to weather, particularly moisture, such that use of such firearm under wet conditions is extremely difficult and frequent misfiring can be experienced. Also, and more significantly, this external positioning of the cap, and the fact that the firing mechanism is positioned in close proximity to the shooter's ear, hence results in substantial noise on firing, which noise is obviously uncomfortable, and in fact can be damaging, to the ears of the shooter.

In addition, most conventional muzzle-loading rifles require that the stock extend a substantial distance beyond the rearward end of the barrel in order to permit the trigger and firing mechanism to be positioned for convenient access by the shooter's hand when the firearm is in a firing position.

Accordingly, this invention relates to an improved muzzle-loading firearm, specifically a rifle, which represents a significant improvement over known firearms of this general type. More specifically, the improved firearm of this invention positions the firing mechanism entirely internally of the stock. In this manner, the noise generated upon firing is hence minimized, as is the danger to the shooter. This also provides protection for the cap, particularly with respect to wet weather conditions, so as to minimize the possibility of misfire.

In addition, in the improved firearm of this invention, the firing mechanism is positioned adjacent the rear of the barrel and projects forwardly thereof, and the trigger mechanism is positioned substantially forwardly from the rear barrel end, which mechanisms are interconnected by a releasable latch, whereby the rifle stock can be substantially shortened in length so that the rear end of the stock is disposed closely adjacent the rear barrel end. However, the trigger and cocking mechanisms are disposed sufficiently forwardly from the rear barrel end as to permit their convenient activation by the user when the firearm is in a firing position wherein the rear of the stock abuts the user's shoulder.

In the firearm of this invention, there is provided a wooden stock having an elongated rifle barrel mounted thereon. The stock has a recess formed therein adjacent the rear end of the barrel, and a conventional firing nipple is positioned within this recess and communicates with the rear end of the barrel bore so as to activate the charge positioned therein. The firing nipple projects forwardly for mounting a conventional firing cap thereon. An elongated firing pin or hammer is slidably supported in the stock forwardly of the detonator cap, and is spring urged toward the firing cap. A trigger mechanism is mounted on the stock at a distance substantially forwardly of the rear barrel end. The trigger mechanism includes a conventional lever-type trigger which, internally of the stock, has a camming and latching relationship with the forward end of the firing pin. The firing pin has a manually engageable knob secured thereto and projecting outwardly through the side of the stock in the vicinity of the trigger mechanism. This knob is gripped to slide the firing pin forwardly to permit it to be latchingly engaged with the trigger when cocking of the firing mechanism is desired. Thereafter a cover hinged to the side of the stock is manually opened to provide access to the recess, and to permit a firing cap to be positioned on the firing nipple. The cover is then closed, and the firearm is ready for firing. When the trigger is squeezed so as to release the latch from the firing pin, the pin is spring urged rearwardly so as to impact against the firing cap, which in turn activates the firing charge located within the rear of the rifle bore.

Other objects and purposes of the invention will be apparent to persons familiar with firearms of this general type upon reading the following specification and inspecting the accompanying drawings.

Figure 1:
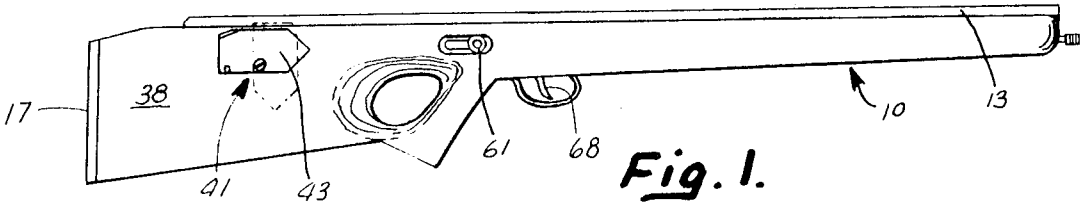
FIG. 1 is a side view of the improved firearm of this invention.

Certain terminology will be used in the following description for convenience in reference only, and will not be limiting. For example, the words "upwardly", "downwardly", "rightwardly" and "leftwardly" will refer to directions in the drawings to which reference is made. The word "front" will refer to the firing or discharge end of the gun, namely the rightward end in FIG. 1, whereas "rear" will refer to the opposite end of the gun, namely the leftward end in FIG. 1. The words "inwardly" and "outwardly" will refer to directions toward and away from, respectively, the geometric center of the firearm and designated parts thereof. Said terminology will include the words specifically mentioned, derivatives thereof, and words of similar import.

DETAILED DESCRIPTION

Referring to the attached drawings, there is illustrated an improved muzzle-loading firearm 10 according to the present invention, specifically a rifle. The firearm includes a stock 11 which is conventionally constructed of wood. A groove or recess 12 extends longitudinally along the top of the stock, and a conventional elongated, muzzle-loading rifle barrel 13 is positioned within the recess 12 and fixed to the stock. The barrel 13 has a conventional rifle bore 14 formed therein which is closed at the rear end 16 thereof. In the preferred embodiment, the rearward end of barrel 13 is positioned in close proximity to the rear or butt end 17 of the stock, such that the butt end projects beyond the rear end 16 of the barrel by only about two to four inches.

The firearm 10 mounts thereon a firing mechanism 21 which communicates with the rear end of the bore 14 so as to activate a conventional charge which is positionable therein. The firing mechanism is activated by the trigger mechanism 22, and an appropriate latch means 23 releasably connects the firing and trigger mechanisms together.

Considering now the firing mechanism 21, same includes a conventional L-shaped firing nipple 31, one end 32 of which is fixed to the rear end 16 of the barrel in a conventional manner. The nipple 31 has the other end 33 thereof disposed so as to project forwardly in the firearm. This other end 33 is designed to mount a conventional cuplike detonator cap 34 thereon. An opening 36, also of an L-shaped path, extends from the end 33 through the other end 32 and through the wall of the barrel for communication with the rearward end of the bore 14. In this manner, upon detonation of the cap 34, the flame travels through the opening 36 into the rear end of bore 14 so as to ignite the charge therein, this being conventional and well known with respect to muzzle-loading firearms.

In the present invention, the firing nipple 31 is positioned within a recess or chamber 37 which is formed within the interior of the stock 11 directly below the rearward end of the barrel 13. This chamber 37 opens outwardly through the side surface 38 of the stock. A suitable cover assembly 41 is provided for closing off this chamber 37. In the illustrated embodiment, this cover assembly 41 includes a mounting plate 42 which is fixed, as by screws, to the side surface 38 of the stock directly adjacent the chamber 37. A substantially rectangular cover or door 43 is connected by a hinge 44 to the mounting plate 42, which cover 43 can be swingably moved into a closed position as illustrated by FIG. 1 so as to totally close off the chamber 37. A latch pin 46 is fixed to the plate 42 adjacent the rear bottom corner of the chamber, which pin 46 is engaged within the cover slot 47 when the cover is closed. The corner of cover 43 is rolled over to form a sidewardly projecting finger tab 48. The side surface of the stock preferably has a small recess or opening 49 formed therein below the lower edge of cover 43, which recess 49 communicates with chamber 37 to permit escape of smoke when the cap is detonated.

The firing mechanism 21 also includes a firing hammer formed as an elongated pin or rod 51 which is slidably supported within the interior of the stock forwardly of the firing nipple 31. This firing pin 51 is slidably supported within an elongated guide tube 52, the latter being fixedly positioned on the stock within an elongated recess 53 formed therein, which latter recess opens upwardly into the barrel-receiving recess 12. This guide tube 52 supports the firing pin 51 for reciprocal sliding movement along a direction which is substantially parallel to the longitudinal axis of the barrel 13. The firing pin 51 is disposed such that the rearward end thereof projects into the chamber 37 in alignment with the firing nipple end 33, whereas the forward end of pin 51 projects into a further chamber 56 which extends transversely of the stock and mounts the trigger mechanism therein.

A conventional compression spring 57 is disposed in encircling relationship to the firing pin 51. The forward end of spring 57 is seated against a shoulder 54 fixed to the tube 52, whereas the rearward end of the spring is seated on a shoulder 55 formed on the pin 51. This spring 57 urges the firing pin rearwardly toward a position of engagement with the nipple end 33.

Firing pin 51 also has a bolt or pin 58 fixed thereto adjacent, but spaced slightly rearwardly from, the forward end thereof. This bolt 58 projects sidewardly through an elongated slot 59 formed in the stock, and an enlarged gripping knob 61 is positioned exteriorly of the stock and is fixed to the bolt 58. The stock preferably has an elongated recess 62 formed therein in surrounding relationship to the slot 59 so that the knob 61 is partially disposed within this recess to minimize its sideward projection from the stock. This knob 61 is manually gripped so as to slide the firing pin forwardly to permit cocking or latching of the firing mechanism, as explained hereinafter.

Considering now the trigger mechanism 22, same includes a trigger member 66 which, in a substantially conventional manner, is disposed within the chamber 56 and is hingedly supported on a hinge pin 67 which is mounted on and extends across the front end of tube 52. The front end of tube 52 is axially slotted to accommodate the trigger member. The trigger member 66 has a conventional curved finger part 68 which projects downwardly below the lower surface of the stock, and this finger part 68 is surrounded by a conventional shroud 69. A compression spring 71 coacts between the stock and the trigger member 66 for normally urging same into a forward position.

The latch means 23 cooperates directly between the firing pin 51 and the trigger member 66. For this purpose, the trigger member 66 is formed as an L-shaped or two-armed lever having a latch arm 76 which projects rearwardly away from the hinge pin 67 toward the firing pin 51. This latch arm 76 includes, adjacent the free end thereof, a latching portion 79 having a lower sloped cam surface 77 which terminates in a forwardly facing shoulder or stop surface 78. This latch arm 76 cooperates with a latching recess 81 formed in the firing pin 51 adjacent the forward end thereof. This recess 81 at its forward end terminates in a rearwardly facing latching shoulder or stop surface 82, which surface is adapted for engagement with the latch surface 78.

The forward end of firing pin 51 also has a forwardly and downwardly sloped cam surface 83 formed thereon, which cam surface extends forwardly from the rear latch shoulder 82 to the front free end of the firing pin.

OPERATION

While the operation of the firearm is believed self-evident from the above description, nevertheless the operation will be briefly described to insure a complete understanding thereof.

Figure 2:
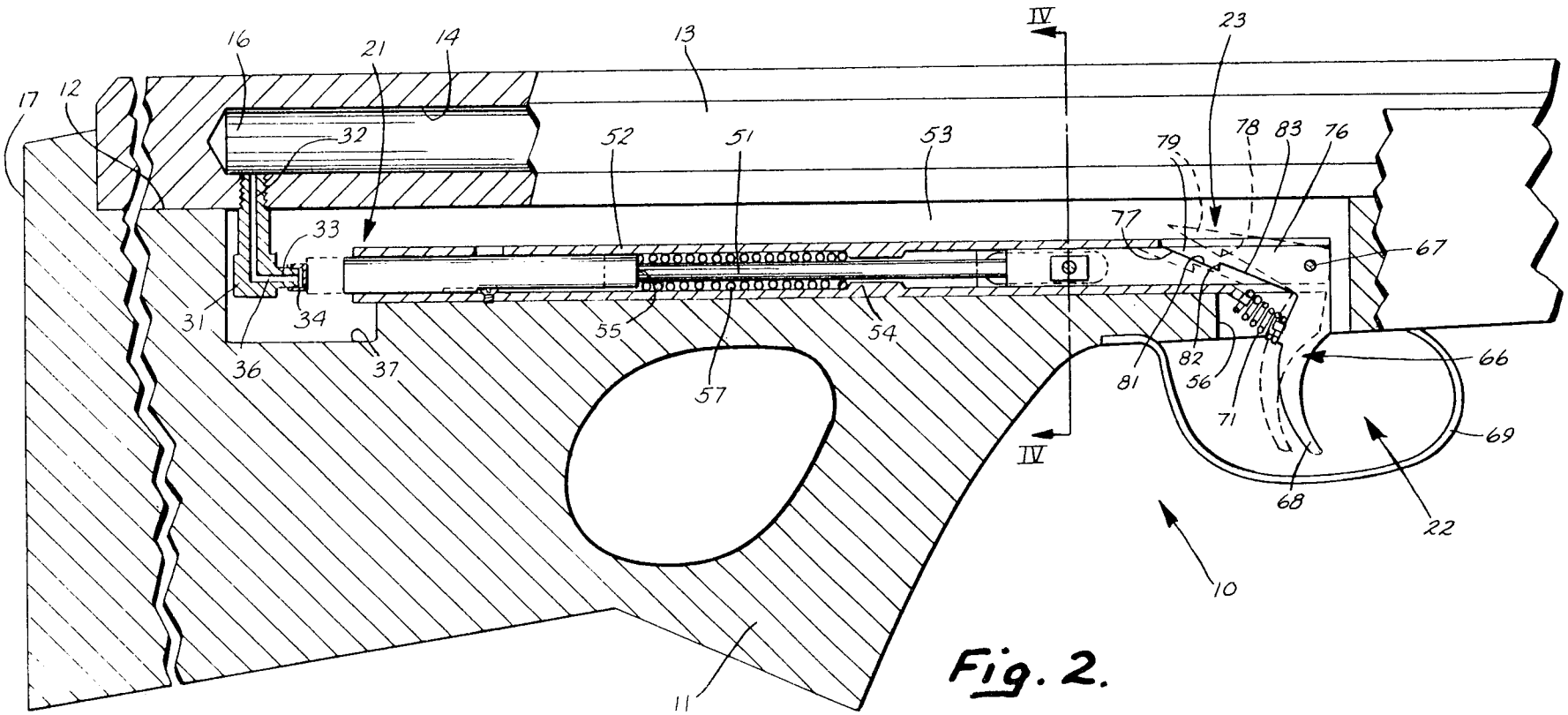
FIG. 2 is an enlarged, fragmentary side view, partly in cross section, of the firearm illustrated in FIG. 1.
Figure 5:
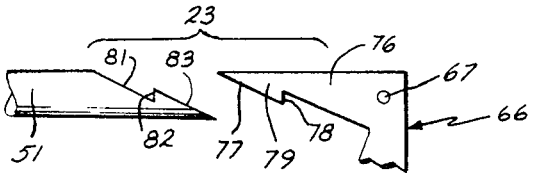
FIG. 5 is a fragmentary exploded view of the latch mechanism.

When in a released position, the firing pin 51 is spring-urged rearwardly so as to abut against the end 33 of the firing nipple 31, as illustrated by dotted lines in FIG. 2. When in this rearward released position, the spring 71 urges the trigger member 66 forwardly (counterclockwise about hinge pin 67) so that the cam surface 77 on the latch arm hence rests against the cam surface 83 formed on the front end of the firing pin.

When it is desired to fire the rifle, and assuming that the charge and projectile have already been rammed into the rearward end of the barrel bore 14, then the shooter manually grips the knob 61 and slides the firing pin 51 forwardly against the urging of the spring 57. This forward movement of pin 51 causes the latch portion 79 to slide upwardly along the cam surface 83 until it passes over the latch shoulder 78, whereupon spring 71 then urges the trigger member 66 in a counterclockwise direction so that the latch portion 79 engages within the latching recess 81. The forwardly facing latch shoulder 78 thus overlaps the rearwardly facing latch shoulder 82, and hence holds the firing pin 51 in its forwardmost (i.e., its cocked or firing) position. The firing pin is thus positioned substantially as illustrated by solid lines in FIG. 2, wherein the rearward end of pin 51 is spaced forwardly a substantial distance from the firing nipple 31.

Figure 3:
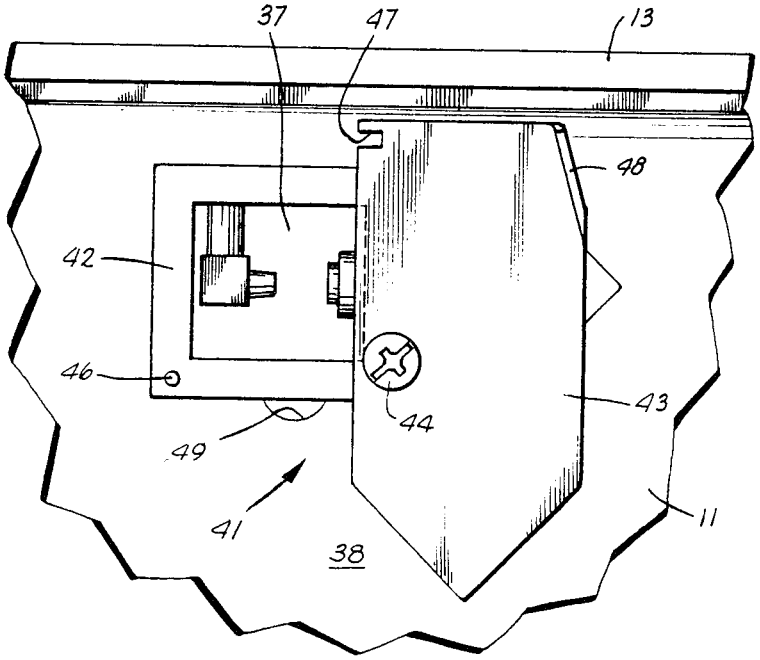
FIG. 3 is an enlarged, fragmentary side view illustrating part of the firing mechanism.
Figure 4:
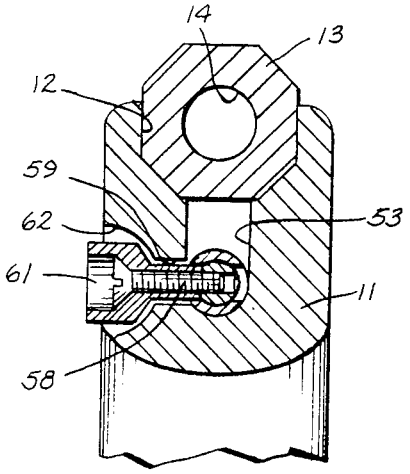
FIG. 4 is a fragmentary sectional view taken substantially along line IV—IV in FIG. 2.

After the firing mechanism has been cocked, as described above, then the cover 43 can be manually swung open (see FIG. 3) to provide access to the chamber 37, which swinging of the platelike cover 43 is within a plane substantially parallel to and adjacent the side surface 38 of the stock. A conventional firing cap 34 is then manually inserted into the recess and positioned on the nipple end 33. The cover 43 is then closed (see FIG. 1), and the firearm is now in condition for firing.

For firing, the gun is positioned such that the butt end 17 thereof is positioned against the shoulder of the shooter. Hence, the firing nipple is thus located in close proximity to the shooter's ear but, due to the positioning of the firing nipple within the closed recess 37, the noise and potential danger created by explosion of cap 34 is minimized.

With the firearm in a firing position, the user can then depress the trigger part 22 rearwardly, which in turn swings the trigger member 66 in a clockwise direction about the pin 67 in opposition to the urging of spring 71. This hence lifts the latch portion 79 upwardly so as to release the firing pin 51, as indicated by dotted lines in FIG. 2, whereupon the spring 57 rapidly urges the pin 51 rearwardly so that it impacts against the cap 34 and effects detonation thereof. This results in transmission of a flame through the passage 36 for igniting the charge in the bore 14.

When the finger pressure on the trigger part 68 is released, spring 71 again urges the trigger forwardly such that the latch portion 79 again bears against the front cam surface 83.

In the firearm 10, the trigger 66 is normally spaced forwardly from the firing nipple 31 by a distance of about six to ten inches, which distance is generally at least two times greater than the distance between the nipple 31 and the butt end 17.

While the invention as described above refers to the firearm as a rifle, it will be appreciated that the present invention is equally applicable to other firearms, such as a musket.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a muzzle-loading firearm having a stock, an elongated muzzle-loading barrel fixedly mounted on the stock, the barrel having an elongated bore opening inwardly from the front end thereof, a firing mechanism having a firing passage communicating with the rearward end of the bore, and a trigger mechanism for activating the firing mechanism, the improvement comprising:

said stock having a chamber formed interiorly thereof and opening outwardly through one of the side surfaces thereof, said chamber being located directly adjacent the rear end of said barrel;

openable and closable cover means mounted on said stock adjacent the side surface thereof for closing the open end of said chamber;

said firing mechanism including a firing nipple positioned within said chamber and fixed to said barrel adjacent the rearward end thereof, said firing nipple having a firing passage therethrough for communication with the barrel bore adjacent the rearward end thereof, said firing nipple having a mounting portion which is disposed within said chamber and projects forwardly in said firearm, said mounting portion being adapted to mount a detonating cap thereon;

said firing mechanism also including a firing member movably mounted on said stock within the interior thereof and positioned forwardly of said mounting portion, said firing member being spring urged into a rearward position for engagement with the cap mounted on said mounting portion;

said trigger mechanism including a trigger member movably supported on said stock and having a finger-engaging part which projects outwardly of said stock, said trigger member being mounted on said stock at a location spaced forwardly a substantial distance from said firing nipple and from the rearward end of said barrel; and latch means coacting between said firing member and said trigger member for releasably holding the firing member in a forward position wherein it is spaced from the cap.

2. A firearm according to claim 1, wherein said firing member comprises an elongated firing rod which is slidably supported within said stock for reciprocal movement between said forward and rearward positions, said firing rod extending generally between said firing nipple and said trigger member and being slidably supported for reciprocal movement along a direction which is substantially parallel with the elongated direction of said barrel.

3. A firearm according to claim 2, wherein said firing rod has an actuating part fixed thereto and projecting sidewardly therefrom through an elongated slot formed in said stock for disposition exteriorly of said stock, said actuating part being disposed adjacent the forward end of said firing rod and positioned in close proximity to said trigger member, whereby said actuating part can be manually pushed forwardly to move said firing rod into said forward position wherein it is latchingly coupled to the trigger member.

4. A firearm according to claim 3, wherein the trigger member comprises a substantially L-shaped lever having first and second intersecting arms, the lever being pivoted at a location spaced from the free ends of the arms, one said arm projecting downwardly from the pivot through the lower surface of the stock and defining thereon the finger-engaging part, the other arm projecting rearwardly toward the firing rod and having a latch portion thereon, and said firing rod having a latching part thereon adjacent the forward end thereof disposed for engagement with the latch portion when the firing rod is in said forward position.

5. A firearm according to claim 4, wherein the latch portion is formed at the free end of said other arm and includes a sloped camming surface which terminates in a forwardly facing latching shoulder, and wherein said firing rod has a sloped camming surface defined thereon adjacent the front free end thereof, which latter camming surface engages the camming surface on the latch portion when the firing rod is in its rearward position, the camming surface on the firing rod terminating at its rearward end in a rearwardly facing latch shoulder which is positionable forwardly of the latching shoulder on the latch portion when the firing rod is in its forward position, and said trigger mechanism including a spring which continuously urges said trigger member in a direction whereby it automatically moves into a position of latching engagement with the firing rod when the latter reaches said forward position.

6. A firearm according to claim 1, wherein the firing nipple comprises a substantially right-angle elbow which is positioned within the chamber such that one leg thereof defines said mounting portion and projects forwardly in substantially parallel relationship to the elongated direction of the barrel, said nipple being positioned adjacent the rearwardmost wall of said chamber so that the mounting portion is spaced a substantial distance from the frontmost wall of the chamber to provide sufficient clearance for mounting of a firing cap on the mounting portion, and said cover means being hingedly connected to said stock for swinging movement about a hinge axis disposed adjacent the frontmost wall of said chamber to permit free access into said chamber when said cover means is open, said cover means also including means associated therewith for normally holding said cover means in its closed position.

7. A firearm according to claim 6, wherein said firing member comprises an elongated firing rod which is reciprocably slidably supported within said stock for movement in a direction which is substantially parallel to the elongated direction of said barrel, said firing rod being positioned forwardly of but substantially aligned with the mounting portion of said firing nipple.

8. A firearm according to claim 7, wherein said trigger member is spaced forwardly from said firing rod by a distance of at least approximately six inches.

9. A firearm according to claim 7, wherein said stock terminates in a butt end which is disposed closely adjacent and only slightly rearwardly of the rear end of said barrel.

10. A firearm according to claim 9, wherein said chamber and said firing nipple are positioned only a small distance from the butt end of said stock, and wherein said trigger member is positioned a rather large distance from the butt end of said stock, which said large distance is several times greater than said small distance.

11. In a muzzle-loading firearm having a stock, an elongated muzzle-loading barrel fixedly mounted on the stock, the barrel having an elongated bore opening inwardly from the front end thereof, a firing mechanism having a firing passage communicating with the rearward end of the bore, and a trigger mechanism for activating the firing mechanism, the improvement comprising:

said stock having a chamber formed interiorly thereof and opening outwardly through one of the side surfaces thereof, said chamber being located directly adjacent the rear end of said barrel;

said firing mechanism including a firing nipple positioned within said chamber and fixed to said barrel adjacent the rearward end thereof, said firing nipple having a firing pasage therethrough for communication with the barrel bore adjacent the rearward end thereof, said firing nipple having a mounting portion which is disposed within said chamber and projects forwardly in said firearm, said mounting portion being adapted to mount a detonating cap thereon;

said firing mechanism also including a firing member movably mounted on said stock within the interior thereof and positioned forwardly of said mounting portion, said firing member being spring urged into a rearward position for engagement with the cap mounted on said mounting portion;

said trigger mechanism including a trigger member movably supported on said stock and having a finger-engaging part which projects outwardly of said stock, said trigger member being mounted on said stock at a location spaced forwardly a substantial distance from said firing nipple and from the rearward end of said barrel; and latch means coacting between said firing member and said trigger member for releaseably holding the firing member in a forward position wherein is is spaced from the cap.

12. In a muzzle-loading firearm having a stock, an elongated muzzle-loading barrel fixedly mounted on the stock, the barrel having an elongated bore opening inwardly from the front end thereof, a firing mechanism having a firing passage communicating with the rearward end of the bore, and a trigger mechanism for activating the firing mechanism, the improvement comprising:

said stock having a chamber formed interiorly thereof and opening outwardly through one of the side surfaces thereof, said chamber being located directly adjacent the rear end of said barrel;

said firing mechanism including a firing nipple positioned within said chamber and fixed to said barrel adjacent the rearward end thereof, said firing nipple having a firing passage therethrough for communication with the barrel bore adjacent the rearward end thereof, said firing nipple having a mounting portion which is disposed within said chamber and projects forwardly in said firearm, said mounting portion being adapted to mount a detonating cap thereon;

said firing mechanism also including a firing member movably mounted on said stock within the interior thereof and positioned forwardly of said mounting portion, said firing member being spring urged into a rearward position for engagement with the cap mounted on said mounting portion;

said trigger mechanism including a trigger member movably supported on said stock and having a finger-engaging part which projects outwardly of said stock; and latch means coacting between said firing member 1 and said trigger member for releasably holding the firing member in a forward position wherein it is spaced from the cap, said latch means being mounted on said stock at a location spaced forwardly from said firing nipple and from the rearward end of said barrel.

* * * * *

UNITED STATES PATENT AND TRADEMARK OFFICE

CERTIFICATE OF CORRECTION

PATENT NO. : 4,503,633

DATED : March 12, 1985

INVENTOR(S) : Clifford Davis

It is certified that error appears in the above-identified patent and that said Letters Patent is hereby corrected as shown below:

Column 8, line 4:

"pasage" should be -- passage --

Column 8, line 25:

"releaseably" should be -- releasably --

Column 8, line 26:

"is is" should be -- it is --

Column 8, line 60:

after "member" delete -- 1 --

Signed and Sealed this

*Twenty-seventh* Day of *August 1985*

[SEAL]

*Attest:*

DONALD J. QUIGG

*Attesting Officer*

*Acting Commissioner of Patents and Trademarks*